United States Patent [19]

Zuber

[11] Patent Number: 4,685,711

[45] Date of Patent: Aug. 11, 1987

[54] LIFTING AND TILTING DEVICE

[75] Inventor: Bretislav P. Zuber, Montreal, Canada

[73] Assignee: Northern Telecom Limited, Montreal, Canada

[21] Appl. No.: 835,505

[22] Filed: Mar. 3, 1986

[51] Int. Cl.[4] ..... B66C 1/54

[52] U.S. Cl. ..... 294/86.41; 294/67.22; 294/93

[58] Field of Search ..... 294/67.2–67.22, 294/67.5, 86.41, 93–97, 103.2; 414/684, 754, 783, 910, 911

[56] References Cited

U.S. PATENT DOCUMENTS

| | | | |
|---|---|---|---|
| 2,817,450 | 12/1957 | Ulinski | 294/86.41 X |
| 2,882,086 | 4/1959 | Steinback | 294/86.41 |
| 2,948,562 | 8/1960 | Foote | 294/67.22 X |
| 3,039,810 | 6/1962 | Bellingher et al. | 294/67.22 |

FOREIGN PATENT DOCUMENTS

| | | | |
|---|---|---|---|
| 6704794 | 10/1968 | Netherlands | 294/86.41 |
| 779253 | 11/1980 | U.S.S.R. | 294/67.22 |
| 906894 | 2/1982 | U.S.S.R. | 294/86.41 |

*Primary Examiner*—Johnny D. Cherry
*Attorney, Agent, or Firm*—R. J. Austin

[57] ABSTRACT

Lifting and tilting device for reels of wound material, in which a support shaft for entering into a bore of a reel is held at one end by a frame having an arcuate track. A lifting block is mounted on the track to enable the frame and the shaft to be tilted by movement of the track through the block. A reel retention device has a lever pivoted to the frame, the lever normally being in a reel retention position to engage one side of a reel flange to prevent its removal from its seat upon the shaft even if the shaft is tilted towards a vertical position.

5 Claims, 8 Drawing Figures

LIFTING AND TILTING DEVICE

This invention relates to lifting and tilting devices for lifting and carrying reels of wound material of indefinite length.

Lifting and tilting devices for lifting and carrying reels of wound material are known. Such reels may be of extreme weight when full and may include reels of wound metal wire, electrical conductor or lengths of steel strip. It is convenient for lifting and tilting devices to be orientated between positions in which a reel has its axis vertically or horizontally. In some situations it is convenient to move wound reels while changing them between horizontal and vertical positions. If the lifting and tilting device is constructed so as to be able to change the orientation of the reel axis then this simplifies the lifting and carrying operation under these conditions.

In one type of lifting and tilting device, a support shaft is used for carrying reels of material. This support shaft is inserted into an axial hole of a reel and expandable gripping elements are used which move outwardly against the surface of the bore of the reel. With the reel held and being carried by the device with its axis in a horizontal position, then no problem is normally found with this type of device. However, should the device be tilted so that the reel axis moves towards a vertical position, then it is imperative that the gripping elements securely hold the reel in position to prevent the reel from sliding from the shaft. Unfortunately it has been found that with the above type of lifting and tilting device, the expandable gripping elements sometimes engage against a greasy bore surface thereby reducing the frictional grip upon the reel. As a result, there is a tendency for the reel to be dropped from the tilting device as it is being oriented towards a position with its axis vertical.

The present invention provides a lifting and tilting device having expandable gripping elements discussed above and in which the above problems are eliminated. The device of the present invention includes a spool retention means in which a lever means is included, the lever means normally urged into a retention position in which it has an abutment surface for abutting engagement with one side of a reel flange to prevent removal of the reel from its seating position on the spindle.

Accordingly, the present invention provides a lifting and tilting device for lifting and carrying reels of wound material of indefinite length comprising: a frame having an arcuate track; a lifting block movable along the track, the block having means for attachment to a flexible lifting member to raise and lower the device; means for locating and gripping a reel, said means comprising a support shaft extending from the frame for insertion into an axial bore of the reel and expandable gripping elements movable radially of the shaft to frictionally engage or disengage the surface of the axial bore; the frame and support shaft being tiltable by movement of the track to change the position of the lifting block upon the track when the frame and shaft are suspended from the block; and a reel retention means comprising a lever means pivotally connected to the frame, the lever means normally urged into a retention position and being movable out of said position, the lever means having an abutment surface for abutting engagement with one side of a reel flange to prevent removal of the reel from a seating position on the shaft with the lever means in the retention position.

One embodiment of the invention will now be described by way of example, with reference to the accompanying drawings, in which.

Figure 1:
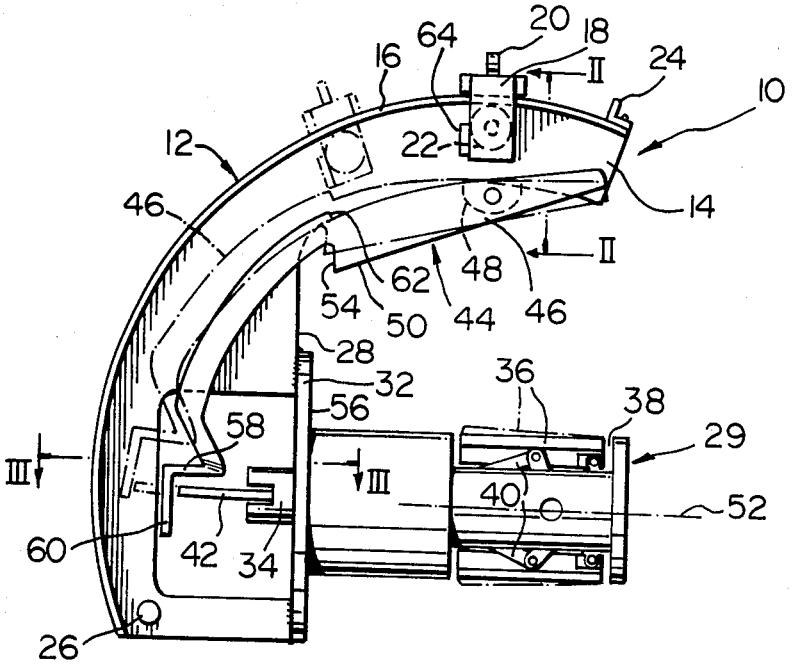
FIG. 1 is a side elevational view of a lifting and tilting device.

The lifting and tilting device 10 shown in the drawings is basically of a conventional construction. This conventional construction will be briefly described followed by more detailed discussion concerning the inventive features which relate to two reel retention means for ensuring that a reel of wound material carried upon the device is held securely in position under all operating conditions.

Figure 2:
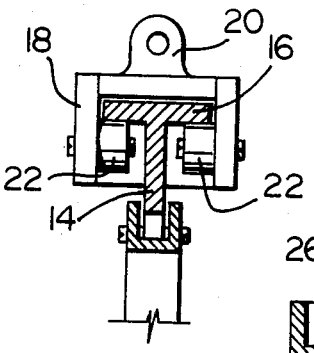
FIGS. 2 and 3 are cross-sectional views lines 11—11 and III—III in FIG. 1 and on a larger scale.

The device, as shown particularly in FIG. 1, comprises a frame 12 which is of T-shaped cross-section (see FIG. 2) to provide a vertical web 14 and a flange 16. The web and flange are of arcuate form, i.e. being part circular with the flange 16 uppermost to form an arcuate track for a lifting block 18. As shown particularly in FIG. 2, the lifting block is of conventional structure in that it is of inverted U-shape and has a lifting eye 20 on its upper surface and two rollers 22 attached to downwardly depending flanges with the rollers disposed beneath and in engagement with the flange 16.

Figure 3:
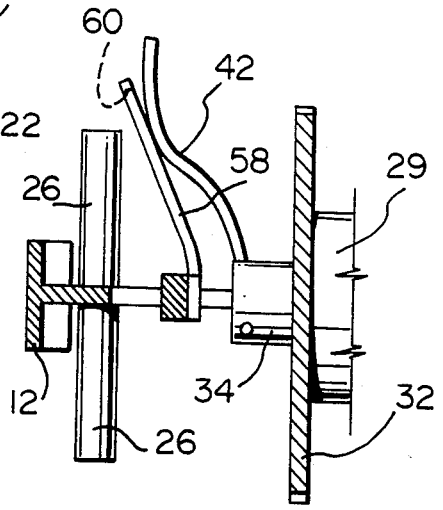

At one end of the frame, the flange 16 is provided with an L-shaped stop 24 for the lifting block (FIG. 1). At the other end of the frame, a handle 26 extends from both sides of the web 14 and this acts as a stop for the lifting block also. The web 14 has one flat edge surface 28 to which is attached a support shaft 29 for carrying a reel 30 of wound conductor wire. The support shaft 29 comprises an end flange 32 which is welded to the surface 28. The shaft is tubular and contains a means 34 for operating expandable gripping elements 36 for gripping the surface of an axial bore of the reel when it is located upon the shaft. These expandable gripping elements 36, as shown in FIG. 1, are of conventional construction in that they project through diametrically opposed apertures 38 provided in the shaft, extend axially of the shaft and are spaced-apart circumferentially. The expandable gripping elements normally occupy a chain-dotted position, as shown in FIG. 1, in which they slope radially outwards from a fixed end of the elements which lies towards a free end of the shaft. The slope is such that when a spool is forced onto the shaft then the gripping elements are caused to move radially inwards upon contact with the surface of the reel bore. The gripping elements are normally held in this outward chain-dotted position by a compression spring means (not shown) which is housed within the left-hand end of the shaft 29 and is operably connected to the gripping elements by operating linkages 40. The operating means 34 is manually operable and, in conventional fashion, has an operating lever 42 which projects from one side of the frame 12 as shown in FIG. 3. Further detail of the conventional operation of the device is considered to be unnecessary.

The device of the embodiment and according to the invention differs from the conventional device in that it also includes two reel retention means.

A main reel retention means 44 is shown clearly in FIGS. 1, 4, 5 and 6. The retention means 44 comprises a lever means in the form of a single lever 46 which is pivoted towards one end upon a lug 48 depending from the frame 12 towards the end having the stop 24. The lever 46 is curved so as to follow the main shape of the frame 12 and also to avoid interference with the reel 30 when it is located upon the shaft 29 except for any interference which is necessary for locking reasons as will be described. The lever 46 has a lower surface which provides a cam surface 50 disposed at an angle to the axis 52 of the shaft for the purpose of being engaged by a reel for lifting the lever out of a retention position (shown in full outline in FIG. 1) when the reel is inserted upon the shaft. The cam surface 50 terminates at its left-hand end, as shown in FIG. 1, in a substantially vertical surface 54 which provides an abutment surface for abutting engagement with one side of a reel flange as will be described. Surface 54 faces in the opposite direction from the surface 56 of the flange 32 which faces along the shaft 29 while the cam surface 50 does not extend as far as the flange 32. The relationship of the two surfaces 54 and 56 is important to ensure that these two surfaces engage opposite sides of a single flange of the reel. From the region of the abutment surface 54, the lever 46 extends in arcuate fashion downwardly towards the operating means 34 and terminates in an operating handle 58. The handle 58 is shaped to lie rearwardly of the handle 42, as shown in the Figures (see particularly FIG. 3), and has a downwardly extending portion 60 to be engaged by the handle 42 when the operating means 34 is being actuated to release the gripping elements from the surface of a reel bore.

The lever 46 normally lies in its retention position, as shown by its dotted outline in FIG. 1, by a spring means (not shown) which may be in any suitable location to provide the turning moment about its pivot point for this purpose. However, the lever is also movable towards a reel release position shown in chain-dotted outline in FIG. 1. The lever 46 has top surface 62 on its upper which, when the lever is in the release position, engages a side plate 64 on the lifting block 18 to restrict relative movement of the lifting block and the track which would result in bringing the lifting block closer towards the handle 26.

Figure 4:
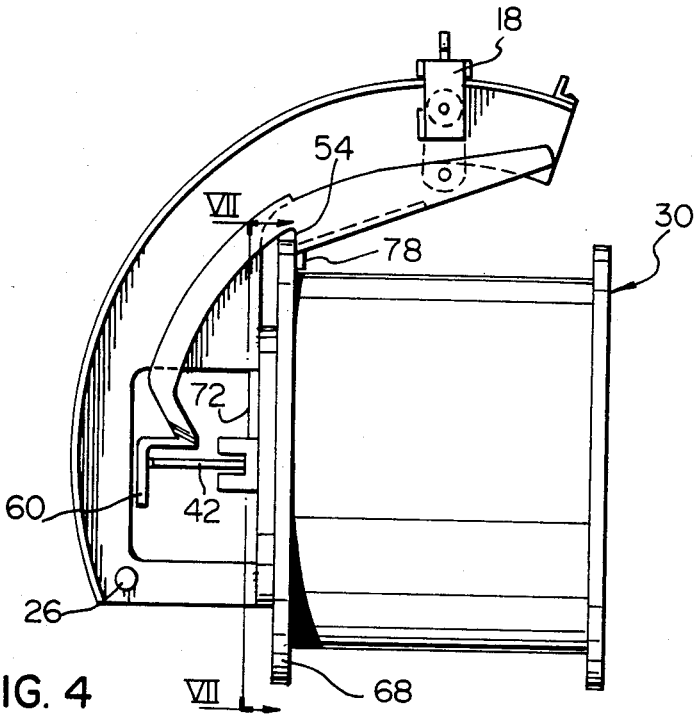
FIG. 4 is a view similar to FIG. 1 with a reel of electrical conductor carried by the device.
Figure 5:
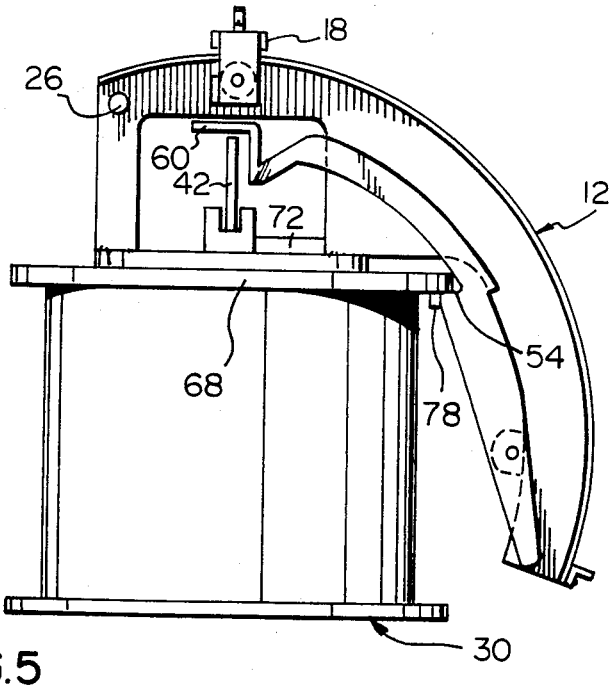
FIG. 5 is a view similar to FIG. 4 with the device oriented into a different position.

The device is used in the following manner. The parts of the device are normally as shown in FIG. 1 with the lever 46 in its retention position (in full outline) and with the gripping elements 36 in their expanded chain-dotted outline positions. With the device suspended from the lifting block by a chain (not shown) passing through the eye 20, the device is moved horizontally on the chain so that its shaft 29 moves through the bore of the reel 30 which is fully wound with copper conductor wire. As the device is moved to engage the reel then the surface of the reel bore contacts the gripping elements 36 and urges them towards their inner positions. As the reel continues along the spindle, its forward flange 68 engages the cam surface 50 of the lever 46 and urges the lever out of its retention position towards the chain dotted position shown in FIG. 1. After the flange 68 has passed the end of the cam surface 50, then the flange 68 engages the surface 56 of the flange 32 and the reel is then in its seating position upon the shaft. In this position and after flange 68 has passed the cam 50, the lever 46 is urged by the spring means into its retention position. The situation is then as shown in FIG. 4 in which the abutment surface 54 engages the surface of the flange 68 opposite to that contacted by the flange 32. The reel may then be carried or tilted so that its axis is in a vertical position. The tilting operation is performed by merely gripping the handles 26 and lifting upwardly to push the frame through the lifting block 18 so that the frame and the reel are located as shown in FIG. 5, i.e. with the reel axis extending vertically. In this position, the lifting block lies close to the handle 26 as shown. If the surface of the bore in the spool tends to be greasy and the gripping elements 36 do not operate completely satisfactorily, there will be a tendency for the reel to fall from the shaft 29. However, this cannot occur because the abutment surface 54 is engaged with the undersurface of the reel flange 68, as shown in FIG. 5, thereby preventing a potential accident.

Figure 6:
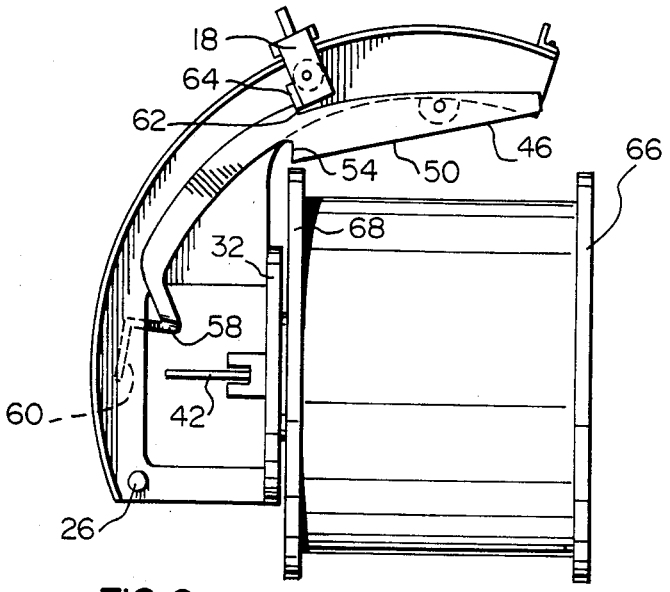
FIG. 6 is a view of the device oriented into a position between FIGS. 4 and 5 and showing a reel retention means in an incorrect position for locking a reel upon the device.

The lifting and tilting device also provides the function of ensuring that the reel cannot drop vertically, i.e. close to the operator, if the device is tilted under conditions in which the reel is not correctly in its seating position. In other words, if the reel is mounted upon the shaft 29 and does not engage the flange 32, then the peripheral surface of the flange 68 is still engaged by the cam surface 50 of the lever 46 so that the lever is in its release position and will not move into its retention position. In such a situation, if the device were to be tilted to the position shown in FIG. 5 and the gripping elements 36 allowed the reel to drop from the shaft 29 then the abutment surface 54 could not prevent this reel movement. However, as shown by FIG. 6, the surface 62 of the lever 46 prevents the vertical orientation of the reel from being assumed. As shown in FIG. 6 with the lever 46 held upwardly in its release position, then the frame may only be moved through the lifting block 18 until the surface 62 engages the plate 64. In this position the axis of the shaft 29 and the reel is only tilted slightly and the whole assembly cannot be tilted further. It follows that if the gripping elements do not hold the reel in this position and allow for slippage, then the reel will fall obliquely away and thus away from the operator.

A further safety precaution is that with the relative disposition of the handles 42 and 60, it is extremely difficult to operate the handle 60 without operation of the handle 42 because a conscious effort must be made to insert a hand between the two handles. It follows that handle 42, in moving to the left as shown in FIG. 3, must be moved a sufficient distance before it engages the downward portion 60 of handle 58 and further movement of the handle 42 in this direction then also moves handle 58 to pivot the lever 46 out of its retention position. As a result of this, the initial operation of handle 42 releases the gripping elements 36 from the reel before the abutment surface 54 is drawn out of engagement with the flange 68. It is virtually impossible therefore for the lever 46 to be removed from the retention position prior to release of the gripping elements from the reel. As a result, the situation does not allow for the gripping elements 36 to be the sole means for holding a reel upon the device when the reel lies with its axis in the vertical position as shown in FIG. 5.

Clearly therefore from the above description, the invention provides a lifting and tilting device which is safe in operation and overcomes all problems which are normally encountered with slippage of a reel upon the support shaft.

Figure 7:
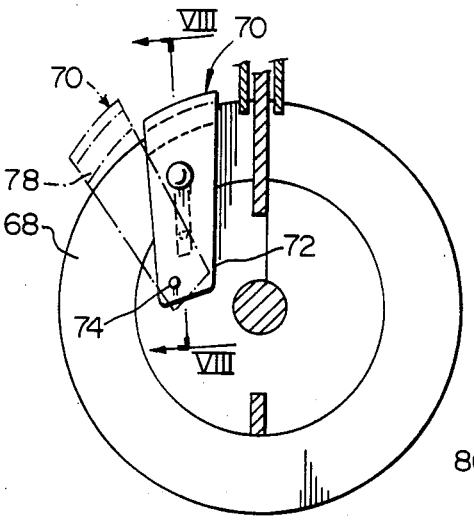
FIG. 7 is a cross-sectional view through the device taken along line VII—VII in FIG. 4.
Figure 8:
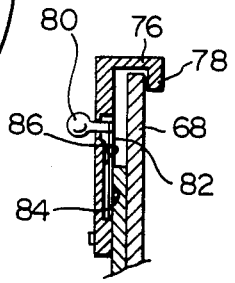
FIG. 8 is a cross-sectional view taken along line VIII—VIII in FIG. 7.

In addition however, the device is equipped with a further spool retention means 70 as shown in FIGS. 7 and 8. This retention means requires a conscious effort to manually operate it and does not automatically locate itself in a retention position. As shown by FIGS. 7 and 8, the retention means 70 comprises a plate 72 which is pivoted about a pin 74 on flange 32. The plate 72 is provided with an axial projection 76 terminating in a locking flange 78. With the retention means in its locking position (full outline in FIG. 7) the locking flange 78 overlies the edge of the flange 68 of the spool (FIG. 8). Thus a further safety device is provided in the event that the lever 46 is being operated incorrectly. The plate 72 may be pivoted between its full outline locking position and an unlocking position (shown in chain-dotted outline in FIG. 7) in which the flange 78 lies clear of the flange 68 of the reel. To move the plate 72 between the two positions a knob 80 is gripped, the knob passing through an aperture in the plate to operate a holding means comprising a spring loaded ball for holding the plate in either position. The arrangement of the parts may be any which is mechanically suitable for the purpose. As shown the plate 82 holds the ball in a socket 84 under the influence of a leaf spring 86 held between the plate 72 and the strip 82.

What is claimed is:

1. A lifting and tilting device for lifting and carrying reels of wound material of indefinite length comprising:

a frame having an arcuate track;

a lifting block movable along the track, the block having means for attachment to a flexible lifting member to raise and lower the device;

means for locating and gripping a reel, said means comprising a support shaft extending from the frame for insertion into an axial bore of the reel and expandable gripping elements movable radially of the shaft to frictionally engage or disengage the surface of the axial bore;

the frame and support shaft being tiltable by movement of the track to change the position of the lifting block upon the track when the frame and shaft are suspended from the block; and a reel retention means comprising a lever means pivotally connected to the frame, the lever means normally urged into a retention position and being movable out of said position, the lever means having an abutment surface for abutting engagement with one side of a reel flange to prevent removal of the reel from a seating position on the shaft when the lever means is in the retention position.

2. A device according to claim 1 wherein the lever means has a cam surface disposed at an angle to an axis of the shaft so as to be engaged by the reel when the reel is located upon the shaft for moving the lever means out of its retention position and allow the reel to move into the seating position.

3. A device according to claim 2 wherein the the lever means has a stop surface which is engageable with the lifting block when the lever means is out of its retention position to limit the relative movement of the track and lifting block towards a vertical position of the support shaft.

4. A device according to claim 3 wherein the expandable gripping elements are normally urged radially outwards, a manually operable means is provided to withdraw the gripping elements radially inwards and a manually operable release means is provided to move the lever means out of the retention position, the two manually operable means coacting to ensure the gripping elements are withdrawn radially inwards before the lever means is moved out of the retention position.

5. A device according to claim 3 provided with a further reel retention means, said further reel retention means comprising a plate pivotally mounted upon the frame and being manually movable into and out of a locking position, holding means provided to retain the plate in the locking position until manually released, and the plate having a locking flange extending inwards towards the shaft axis for location against a side of a reel flange to prevent removal of the reel from the seating position.

* * * * *